United States Patent [19]

Crawford

[11] 3,956,039

[45] May 11, 1976

[54] HIGH EXPLOSIVE COMPOUND

[75] Inventor: Theodore C. Crawford, Los Alamos, N. Mex.

[73] Assignee: The United States of America as represented by the United States Energy Research and Development Administration, Washington, D.C.

[22] Filed: Jan. 13, 1956

[21] Appl. No.: 559,081

[52] U.S. Cl. ..... 149/21; 149/105; 149/109.2; 423/283; 149/114

[51] Int. Cl.[2] ..... C06B 45/02; C06B 25/04; C06B 23/00; C01B 35/10

[58] Field of Search ..... 52/5, 7, 11, 1 A; 149/21, 105, 109.2; 423/283

[56] References Cited

UNITED STATES PATENTS

| | | | |
|---|---|---|---|
| 2,866,811 | 12/1958 | Irish | 149/108.4 |
| 3,126,305 | 3/1964 | Armstrong | 149/109.2 |
| 3,619,306 | 11/1971 | Bertnmann | 149/105 |
| 3,653,996 | 4/1972 | Edwards | 149/105 |
| 3,672,851 | 6/1972 | Ihm | 149/19.8 |

FOREIGN PATENTS OR APPLICATIONS

| | | |
|---|---|---|
| 6,937 | 1896 | United Kingdom |
| 572,731 | 2/1924 | France |

*Primary Examiner*—Benjamin R. Padgett
*Assistant Examiner*—Donald P. Walsh
*Attorney, Agent, or Firm*—Dean E. Carlson; Paul D. Gaetjens

EXEMPLARY CLAIM

1. A low detonation velocity explosive consisting essentially of a particulate mixture of ortho-boric acid and trinitrotoluene, said mixture containing from about 25 percent to about 65 percent by weight of ortho-boric acid, said ortho-boric acid comprised of from 60 percent to 90 percent of spherical particles having a mean particle size of about 275 microns and 10 percent to 40 percent of spherical particles having a particle size less than about 44 microns.

2 Claims, No Drawings

HIGH EXPLOSIVE COMPOUND

The present invention is related to high explosives and in particular to high explosives having pre-selected detonation velocities.

In the field of high explosives, the detonation velocity of the well-known castable and machinable explosives is not always suitable for certain special applications and it is necessary to change the detonation velocity by some means such as by adding other materials to the explosive. Trinitrotoluene (TNT), for example, possesses properties which make it well suited for use as a castable and machinable explosive, but for certain controlled conditions it is necessary to use an explosive having a slower detonation velocity than TNT. This has been accomplished by adding relatively large amounts of inert inorganic material such as barium nitrate, lead nitrate, or potassium nitrate to molten TNT, thereby forming a slurry with satisfactory casting properties.

One of the refinements in the field of high explosives has been the development of high-explosive lenses that shape the detonation shock wave when it passes through the lens so that it emerges in a prescribed pattern. This phenomenon is somewhat comparable to the shaping of light waves in optical lenses as the shock wave is bent or formed in much the same manner as a ray of light. For example, if a right cylinder of explosive such as TNT is detonated from a point source in the center of one of the plane ends, the shock wave that emerges from the opposite end will be spherical in nature with the point of detonation the origin. However, if within the cylinder of TNT a properly shaped cone of a high explosive having a slower detonation velocity is inserted with the apex toward the point of detonation, a shock wave from this exploding lens will emerge as a plane wave parallel to the end of the cylinder. Thus, there is a need for high explosives having different shock-wave velocities, for with them the shaping of shock waves is almost unlimited. This phenomenon is described in more detail in U.S. Pat. No. 2,604,042.

Baratol, a well known low detonation velocity explosive, has been used very successfully for the "slow" component of explosive lenses. However, the past uses of Baratol have not required that the composition have a low crystalline density. With progress of nuclear science, certain applications have arisen wherein there is a stringent requirement that the "slow" explosive be made by using additives comprised of low Z elements (Z=atomic number). For example, in studies of equation of state or material density when a material is subjected to a shaped detonation shock wave, it is a problem to determine the material velocity or density during the very short time of the experiment. One method of determining these characteristics is to use a means of radiation positioned so that the absorption of radiation by the material being studied is related to density. It can be seen that the sensitivity or resolving power of such a system is dependent upon the radiation absorption by any other material adjacent to the material being studied, in this case high explosives. One experiment which uses this principle is a study of the movement of the surface of a metal block upon which is placed a high-explosive lens. A copious source of low energy X-rays pass parallel to the plane of the interface between the high explosive lens and the metal block surface. A detector is placed opposite the block and high explosive so that the X-rays must pass through the region of the interface to reach the detector. In passing parallel to the surface under study, great sensitivity to surface condition and position is achieved. Therefore it can be seen that it is necessary that the high explosive be composed of elements having as low a Z as possible. The stopping power of the elements to radiation of about 25 kv energy is proportional to the fourth or fifth power of the atomic number. Aluminum ($Z = 13$) would, by this ratio, have a per atom stopping power of about 10 times that of oxygen ($Z = 8$). Therefore it is very important that the high explosive consist primarily of low Z-elements. Theoretical considerations have shown that elements near oxygen are a practical upper limit of the atomic scale for explosive additives when efficient passage of low energy radiation is desired.

Another advantage derived from using a low density material as the additive in an explosive lens, is the saving in weight which can become important, for example, if the object is to be transported by air. Furthermore it is possible to improve on the safety of Baratol, and an explosive having greater safety, would represent no small advantage.

Prior to the disclosed invention it has been an accepted understanding among those skilled in the art that only materials having a high crystalline density such as, for example, barium nitrate, lead nitrate, or potassium nitrate, could produce the desired result of slowing down the velocity of detonation of TNT as discussed above. These materials probably absorb energy from the shock wave as the shock wave moves them due to their high mass.

An example of such a so-called "slow-explosive" is Baratol, previously discussed, a mixture of 76 percent barium nitrate and 24 percent alpha TNT by weight. The stick detonation velocity of Baratol compares to 100 percent TNT as follows:

| | |
|---|---|
| 100% TNT | Detonation velocity - 6950 m/sec. |
| Baratol | Detonation velocity - 4900 m/sec. |

Thus it can be seen that the addition of an inert high crystalline density material has a marked effect on the detonation velocity of an explosive. Further, other proportions of TNT and barium nitrate will yield other detonation velocities.

One method of the prior art used to reduce the detonation velocity in TNT and at the same time reduce the density comprises aerifying the molten TNT while it is cooling and solidifying, so that pockets of air are entrapped in the solid TNT. This method has a very limited use, as it is subject to the serious disadvantage that the resultant detonation velocity can not be pre-determined as it will vary from batch to batch. Also, the density will vary depending upon the amount of entrapped air and it will be impossible to predict either density or detonation velocity with any accuracy.

Another method comprises lowering the explosive density by adding such substances as sawdust. This method has the disadvantage of poor fabrication qualities and poor safety characteristics as a rather sensitive explosive such as nitroglycerin must usually be used.

As previously stated when additives are used to reduce the detonation velocity of an explosive these additives, according to the prior art, should have a high density when good fabrication qualities, mechanical strength and good safety characteristics are required. However, by the methods of this invention, it is possible to mix a low crystalline density additive with alpha TNT and achieve the desired result of a lower reproduceable detonation velocity. An added advantage is a lower density than pure TNT and a safety unexcelled in the explosive field.

It is, therefore, an object of the present invention to provide an explosive composition comprising a mixture of a low crystalline density compound with an explosive to yield a lower detonation velocity than the pure explosive.

Another object of the present invention is to provide an explosive composition having a lower density than the pure explosive.

Another object of the present invention is to provide an explosive composition having a lower density and greater safety than the pure explosive.

Another object of the present invention is to provide a means and method for preparing the explosive as provided by the above objects.

Another object of the present invention is to provide a means and method for preparing an explosive as provided by the above objects wherein the explosive has good casting qualities and reproducibility of physical characteristics.

Further objects of the present invention will be apparent from the following specification.

The present invention comprises mixing the order of 60 percent ortho-boric acid with alpha TNT to produce an explosive having a detonation velocity comparable to Baratol. This explosive composition made in accordance with the present invention is hereinafter designated as Boracitol.

To prepare the explosive of this invention TNT is melted at a temperature of about 90°C in a suitable container preferably surrounded by a water bath. The desired amount of boric acid is then added to the molten TNT. The resulting slurry is now mixed and additives, as described below, may be introduced. Mixing is continued until the whole is homogeneous. Then a vacuum of 0.5 psia is applied for 1 hour to remove the entrapped air. Finally the slurry may be allowed to cool in the pot or else poured into molds to cast to a desired shape. If the explosive of the present invention is to be prepared for casting, the fluidity or pourability of the slurry, is very important. Several factors have been found which very greatly affect the fluidity. The particular size of the boric acid grains as well as the distribution of particle sizes and particle shape are very important. Another factor is the type and the amount of additives which are added in very small quantities to improve the fluidity by lowering the viscosity of the molten slurry. Some of these additives are tristearin, anthracene, hexylgallophenone and decylgallophenone. Removal of the entrapped air by applying a vacuum to the slurry is done primarily to avoid having air bubbles in the casting which would affect reproducibility of detonation velocity.

The ortho-boric acid must be of particles that are spheroidal in shape if the Boracitol is to have pouring characteristics. It has been found preferable to use from 60 to 90 percent coarse grain or granular and the balance powdered boric acid. The granular boric acid should be of such a particle distribution as to have a mean diameter of about 275 microns, and the powdered boric acid should have a particle size less than 44 microns. The spheroidal shape of these particles is of extreme importance as it has been found that ordinary ground boric acid, when melted with TNT, forms a slurry that is virtually impossible to pour into a mold. Further, it has been found if the boric acid used for this invention is forced through sieves the spheroidity of the particles may be changed sufficiently as to make it unusable.

The ratio of granular boric acid to powdered, may vary from 60:40 to 90:10; however, it has been found that the range 60:40 to 80:20 is best with 75:25 being about optimum.

For most casting applications, the preferred slurry is that which has the minimum viscosity. Besides the boric acid particle size, another control of viscosity is the use of additives. Wetting agents such as gallocyanine or hexylgallophenone are useful for this purpose. When a wetting agent is used, the addition of 0.03 to 0.15 percent of hexylgallophenone or decylgallophenone is preferred.

For many applications, the explosive can be stabilized by the addition of an anticracking agent. Anthracene has been found suitable for this purpose and is added in the percentage of 0.1 percent to 3 percent.

A further advantage of the explosive mixture of the present invention is the extraordinary safety feature. Boracitol is remarkably insensitive to shocks or blows and must be detonated by a very strong explosive such as composition B. Boracitol made according to the composition of the preferred embodiment is also nonflammable to such an extent that it will not burn even when placed in a pan of burning toluene. Whereas ordinary explosive scrap can be disposed by burning or exploding with a simple dynamite cap, Boracitol must be melted in boiling water and the boric acid removed with the water solution. The TNT will settle to and may be removed from the bottom of the boiling water container. Thus it can be seen that quantities of Boracitol can be stored in complete safety, and scrap from machining operations does not have to be handled with any more caution than other shop materials. The safety properties of this explosive suggest uses also in military applications or for conditions where transportation hazards exist. It has further been found that Boracitol made with an appreciably lower percentage of boric acid than the preferred embodiment will improve the safety of TNT as long as more than a few percent of boric acid is added to the TNT. For example a Boracitol made with 25 percent boric acid will burn very slowly and barely support its own combustion. This composition will have a higher detonation velocity than the preferred embodiment and is suggested for additional uses such as in military or mining applications.

Boracitol has remarkable machining properties and may be readily machined to various shapes with ordinary tools. It may actually be worked with hand tools and is not nearly as abrasive as many explosives of the prior art.

The suggested embodiments of the present invention may be summarized as follows:

For an explosive having characteristics quite similar to TNT but with greater safety, about 25 percent boric acid is suggested.

For an explosive which is to be left in the melting pot to freeze, any form of boric acid as regard particle size and shape is suitable and additives will not be required.

For an explosive which is to be poured, boric acid having a coarse to powdered grain size ratio of about 75:25 is suggested. In this case the boric acid particles should be spheriodal in shape as previously described.

Inasmuch as the detonation wave velocity of Boracitol varies with percentage of boric acid added, the table below illustrates several compositions and detonation wave velocity values.

TABLE A

| STICK DETONATION VELOCITY (3" Dia.) | | | |
|---|---|---|---|
| % Boric Acid | % TNT | Other | Velocity |
| 54 | 46.0 | None | 5060 m/sec |
| 59.2 | 40.8 | None | 4955 m/sec |

TABLE B

| CONVERGING LENS DETONATION VELOCITY VALUES | | | |
|---|---|---|---|
| % Boric Acid | % TNT | Other* | Velocity |
| 60 | 39.8 | 0.2[1] | 4930 m/sec. |
| 62 | 37.8 | 0.2[1] | 4890 m/sec. |
| 65 | 34.8 | 0.2[1] | 4820 m/sec. |
| 67 | 32.8 | 0.2[1] | 4760 m/sec. |
| 62 | 36.9 | 1.1[2] | 4840 m/sec. |
| 65 | 33.9 | 1.1[2] | 4770 m/sec. |
| 68 | 30.9 | 1.1[2] | 4670 m/sec. |

TABLE C

| PLANE WAVE DETONATION VELOCITY | | | |
|---|---|---|---|
| % Boric Acid | % TNT | Other* | Velocity |
| 50 | 49.8 | 0.2[1] | 5225 m/sec |
| 55 | 44.8 | 0.2[1] | 5050 m/sec |
| 60 | 39.8 | 0.2[1] | 4800 m/sec |

*[1] 1% each anthracene and hexylgallophenone
*[2] 1% anthracene and 0.1% hexylgallophenone It has been found that above about 68 percent boric acid, the mixture no longer behaves as an explosive and it does not propagate a detonation wave.

It is understood that preceding suggested compositions are approximate and a great number of combinations of compositions are possible. The basic concept of the present invention has been shown, and minor changes may be made within the scope of the present invention. Other cracking inhibitors and wetting agents may be added to the explosive of the herein disclosed invention without materially affecting its performance or, the explosive may be prepared without additives. Less hexylgallophenone may be used than the suggested 0.1 percent and in some applications it has been found better to use 0.05 percent. More anthracene may be used than the suggested 0.1 percent and in some applications it has been found more desirable to use about 3 percent of anthracene. There are other methods known in the art for preparing a slurry of molten explosive and these may be used to suit the production requirements.

A further modification of the present invention is the addition of orthoboric acid to any explosive containing some TNT, such as composition B, a mixture of RDX and TNT. Or, it can be used alone with RDX if a suitable binding agent is added, as RDX does not melt and is not castable except with binding agents such as, for example, TNT or plastics.

Therefore, it is understood that the scope of this invention embraces any or all of the modifications of the appended claims.

What is claimed is:

1. A low detonation velocity explosive consisting essentially of a particulate mixture of ortho-boric acid and trinitrotoluene, said mixture containing from about 25 to about 65 percent by weight of ortho-boric acid, said ortho-boric acid comprised of from 60 to 90 percent of spherical particles having a mean particle size of about 275 microns and 10 to 40 percent of spherical particles having a particle size less than about 44 microns.

2. A low detonation velocity explosive consisting essentially of a particulate mixture of ortho-boric acid and alpha trinitrotoluene, said mixture containing about 60 percent by weight of ortho-boric acid, said boric acid comprised of about 77 percent spherical particles having a mean particle diameter of about 275 microns and about 23 percent of spherical particles having a particle diameter less than about 44 microns.

* * * * *